US006989741B2

(12) United States Patent
Kenny et al.

(10) Patent No.: US 6,989,741 B2
(45) Date of Patent: Jan. 24, 2006

(54) OBJECT TRACKING

(75) Inventors: Thomas Kenny, Troy, MI (US); Raj Chawla, Neenah, WI (US); Ernest Pacsai, Wixom, MI (US); Carl Szasz, Rochester Hills, MI (US); Robert Gilling, Caro, MI (US); Thomas Marquardt, Troy, MI (US)

(73) Assignee: G-5 Electronics, Troy, MI (US)

( * ) Notice: Subject to any disclaimer, the term of this patent is extended or adjusted under 35 U.S.C. 154(b) by 263 days.

(21) Appl. No.: 10/214,642

(22) Filed: Aug. 7, 2002

(65) Prior Publication Data

US 2004/0036595 A1 Feb. 26, 2004

(51) Int. Cl.
*G08B 26/00* (2006.01)

(52) U.S. Cl. ..... 340/505; 340/539.1; 340/539.11; 340/539.13; 340/539.32; 340/572.1

(58) Field of Classification Search ..... 340/505, 340/539.1, 539.11, 539.13, 539.32, 572.1, 340/7.27, 10.1, 10.2
See application file for complete search history.

(56) References Cited

U.S. PATENT DOCUMENTS

| | | | | |
|---|---|---|---|---|
| 5,801,628 | A | 9/1998 | Maloney | 340/568 |
| 6,104,285 | A * | 8/2000 | Stobbe | 340/505 |
| 6,150,921 | A | 11/2000 | Werb et al. | 340/10.1 |
| 6,204,764 | B1 | 3/2001 | Maloney | 340/568.1 |
| 6,265,962 | B1 | 7/2001 | Black et al. | 340/10.2 |
| 6,335,686 | B1 | 1/2002 | Goff et al. | 340/572.4 |
| 6,346,884 | B1 | 2/2002 | Uozumi et al. | 340/572.1 |
| 6,354,493 | B1 | 3/2002 | Mon | 235/380 |
| 6,369,711 | B1 | 4/2002 | Adams et al. | 340/572.1 |

* cited by examiner

*Primary Examiner*—Daryl C Pope
(74) *Attorney, Agent, or Firm*—Law Office of Stanley K. Hill, PLC

(57) ABSTRACT

Methods and systems for tracking objects. Systems of the present invention include a base station capable of transmitting and receiving signals at multiple frequencies. Each object to be tracked has attached to it what for the purpose of the present specification is referred to as an electronic tag ("E-Tag"). Each E-Tag can transmit signals that can be received and interpreted by the base station and each E-Tag can receive and interpret signals transmitted by the base station. The transmitting (and receiving) of signals between the base station and an E-Tag allows the base station to track the E-Tag, and therefore, track the object to which the E-Tag is attached. Methods utilized to track objects in accordance with the present invention vary depending on the distance of the object from a base station ("range" of the object). The distances from the base station are divided into zones with the lowest numbered zone (that is, zone 1) being closest to the base station and the highest numbered zone being farthest away from the base station. Typically, embodiments of the present invention are adapted to track objects in four different zones. LF and HF communications can be utilized to track objects in zones 1 and 2, triangulation can be used to track objects in zone 3, and global location techniques can be utilized to track objects in zone 4. In a typical application, zone 1 covers a storage enclosure such as a desk drawer, a file cabinet, or a safe for example. Zone 2 frequently covers a room or a building, zone 3 covers up to the maximum distance for which triangulation technology can be used to track an object, and zone 4 covers the maximum distance for which global location techniques can be used to track an object.

26 Claims, 5 Drawing Sheets

OBJECT TRACKING

FIELD OF THE INVENTION

The present invention relates generally to object tracking. More specifically, the present invention relates to the use of RFID technology and triangulation technology to track objects at varying distances from a source.

BACKGROUND OF THE INVENTION

Various types of systems and methodologies are known in the art for tracking items. Tracking an item may involve locating or identifying a stationary object (a car key, book, or file, for example) that has been temporarily misplaced. One example of such a system is referred to as an inventory control system. When the object is valuable, such as with jewelry, or the key to a vehicle, it may be desirable to control access to the object, or to locate the object within a predetermined area. Tracking can also involve a continuous monitoring of a moving object (personnel or vehicles, for example) over a period of time.

It is known in the art to utilize radio frequency identification ("RFID") technology for tracking objects. Generally, an RFID tag is attached to each object to be tracked. Typically, each tag has data stored on in that is associated with the object to which the tag is attached. Usually, the tag will contain an identification number that uniquely identifies the associated object, but the tag may contain other data as well. Conventional RFID tracking systems comprise an interrogator that scans for tags by transmitting an interrogation signal at a known frequency. RFID tags that are within range of the interrogator are activated and respond to the interrogator with a response signal that contains data associated with the object, such as an RFID tag ID. The interrogator detects the response signal and decodes that data, such as the RFID tag ID. Additionally, an interrogator can use a known tag ID to interrogate the specific RFID tag identified by the tag ID to receive stored data associated with the object to which the tag is attached. The act of an interrogator capturing stored data is commonly called an RFID read and the device doing the interrogating is commonly called an RFID reader.

One example of a tracking system utilizing RFID technology is the key tracking system disclosed in U.S. Pat. No. 6,204,764 issued to Maloney ("Maloney"), the disclosure of which is hereby incorporated by reference. The system disclosed in Maloney is limited in that the system requires a plurality of receptacles and the RFID tags are only activated when the associated object is placed in a receptacle. A second disadvantage of the system disclosed in Maloney is that it requires a separate transceiver for each storage receptacle within the storage box. A third disadvantage of the system disclosed in Maloney is the potential for signal collision when multiple objects are put in the same receptacle.

SUMMARY OF THE INVENTION

The present invention addresses the limitations presented above as well as other limitations of the prior art and provides additional benefits as evidenced by the present specification. For example, the present invention provides the capability to track objects using a single base transceiver. Additionally, the present invention does not require the tracked objects to be placed in a receptacle or oriented in any way. Another benefit arises out of the present inventions use of multiple technologies to extend the range for tracking objects. The present invention can be advantageously utilized to track many different kinds of objects in many different applications. These aspects and other teachings disclosed in the present specification provide more user friendly methods of object tracking.

Systems of the present invention include a base station capable of transmitting and receiving signals at multiple frequencies. According to the present invention, each object to be tracked has attached to it what for the purpose of the present specification is referred to as an electronic tag ("E-Tag"). Each E-Tag can transmit signals that can be received and interpreted by the base station and each E-Tag can receive and interpret signals transmitted by the base station. The transmitting (and receiving) of signals between the base station and an E-Tag allows the base station to track the E-Tag, and therefore, track the object to which the E-Tag is attached.

The methods utilized to track objects in accordance with the present invention vary depending on the distance of the object from a base station ("range" of the object). The distances from the base station are divided into what are herein referred to as zones with the lowest numbered zone (that is, zone 1) being closest to the base station and the highest numbered zone being farthest away from the base station. Typically, embodiments of the present invention are adapted to track objects in four different zones. However, some applications of the present invention may advantageously utilize more than four zones. In a typical application, zone 1 covers a storage enclosure such as a desk drawer, a file cabinet, or a safe for example. Zone 2 frequently covers a room or a building, zone 3 covers up to the maximum distance for which triangulation technology can be used to track an object, and zone 4 covers the maximum distance for which global location techniques can be used to track an object.

One advantage of the present invention is that a system and method of communicating with an object is provided that identifies and locates an object. Still another advantage of the present invention is that a system and method is provided that utilizes a low radio frequency signal and high radio frequency signal and triangulation to locate and communicate with the object. Other features and advantages of the present invention will be readily appreciated, as the same becomes better understood after reading the subsequent description taken in conjunction with the accompanying drawings.

DESCRIPTION OF THE DRAWINGS

The present invention is illustrated by way of example in the following drawings in which like references indicate similar elements. The following drawings disclose various embodiments of the present invention for purposes of illustration only and are not intended to limit the scope of the invention.

DETAILED DESCRIPTION OF THE INVENTION

Figure 1:
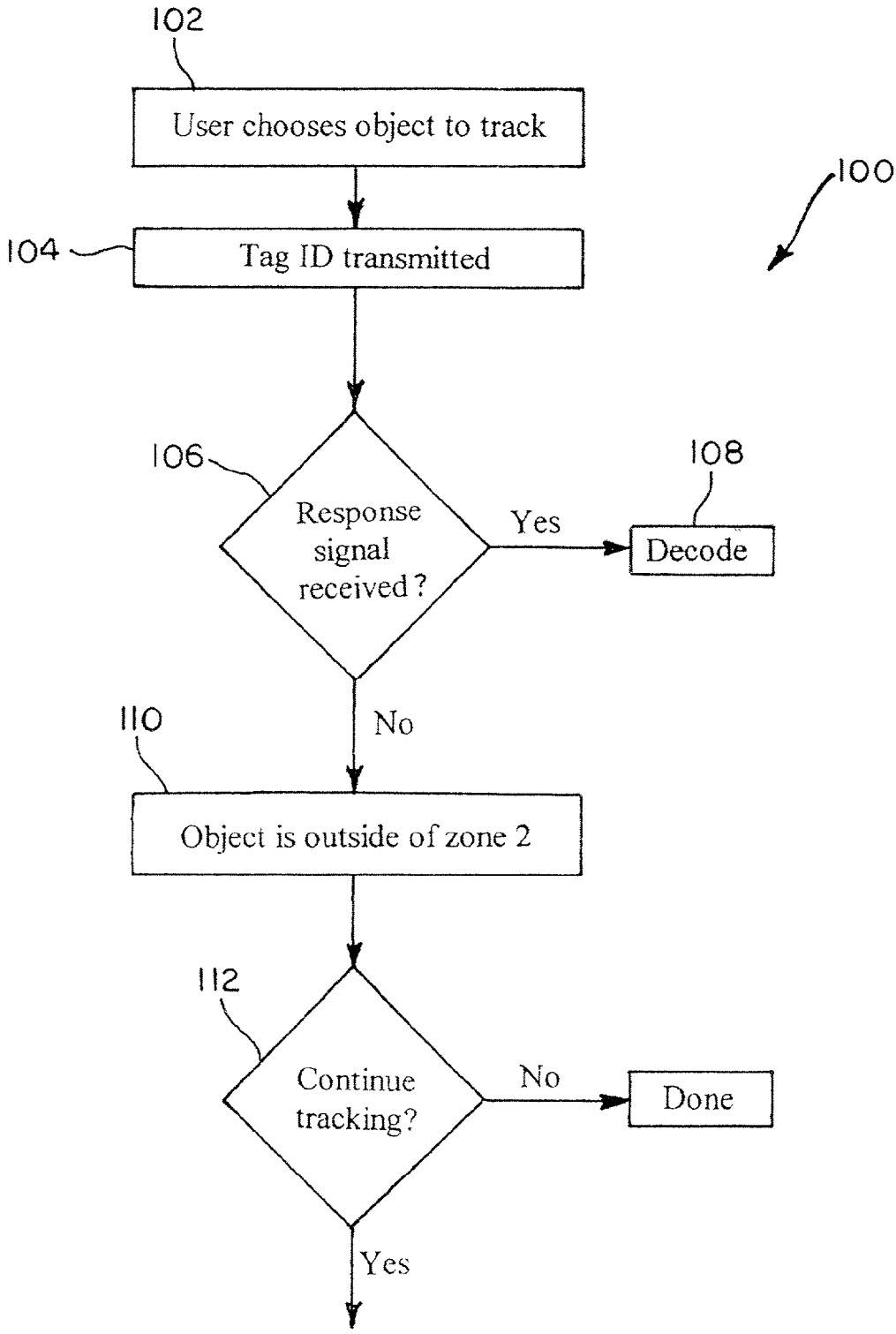
FIG. 1 illustrates a flowchart of a method of the present invention.

In the following detailed description of the present invention, reference is made to the accompanying Drawings, which form a part hereof, and in which are shown by way of illustration specific embodiments in which the present invention may be practiced. It should be understood that other embodiments may be utilized and structural changes may be made without departing from the scope of the present invention.

The present invention provides capabilities for tracking many different kinds of objects in many different applications. According to the present invention, each object to be tracked has an E-Tag attached to it. Each E-Tag comprises electronics that allow the tag to have wireless communication with a base station as described herein. Thus, E-Tags have associated with them a unique ID ("tag ID") that uniquely identifies the E-Tag and, therefore, uniquely identifies the object to which the E-Tag is attached. Each E-Tag may also have other data stored on it that is associated with the object to which the E-Tag is attached. As described below, E-Tags also include sufficient electronics to enable them to be tracked using triangulation technology.

In addition to E-Tags, systems of the present invention comprise a base station capable of communicating with the E-Tags. The base station also comprises a user interface. Typically, the user interface is implemented by a personal computer executing interface software with which a user interacts to use a system of the present invention.

Base stations of the present invention generate a low frequency signal ("LF carrier signal"). The range of the LF signal defines the zone closest to the base station (that is, zone 1). That is, if an E-tag is sufficiently close to the base station to receive the LF signal, then the E-tag is in zone 1. E-tags of the present invention have an LF receiver and the LF signal is used to provide wireless communication between the base station and the E-tag.

In a preferred embodiment, the E-tags are battery operated and the use of an LF wireless signal allows very low power receivers to be used in the battery-operated E-tag. The use of low power receivers extends the battery life of the E-tag. Energy contained in the LF signal can be used to power the device and re-charge the battery when the E-tag is in zone 1, further extending battery life. The LF energy is detected by a magnetic field, which provides security by rolling off field strength at a $1/R^3$ rate. (R=range from base station to E-tag).

The LF signal can be transmitted with multiple polarities or received with multiple polarities to allow the signal to be received independent of E-tag orientation. Thus, in one embodiment, the base station transmits LF data on a modulated frequency in three different polarities. Another embodiment of the present invention uses a single transmit polarity at the base station and three polarities of receivers in the E-tag. Multiple polarity antennas are placed orthogonal to each other. The signals can be transmitted to or received from each of the antennas using time diversity or by using a phase shift at each antenna. Using multiple polarity antennas and transmitting at different polarities provides orientation independence of the LF channel. For example, if the tracked objects are automobile keys stored in a desk drawer, the keys can be placed in the drawer in any manner and still be able to receive the LF signal. That is, the keys are not required to be placed in any receptacles or set in any particular orientation.

In a typical operation of the present invention, the base station transmits the tag ID of the object to be tracked ("target object") via a modulated LF carrier signal. Preferably, the frequency of the LF carrier signal will be greater than about 30 kHz and less than about 15 MHz. The range of the LF carrier signal containing the tag ID will vary with the frequency and/or power of the signal. Thus, one of ordinary skill in the art can choose the range of zone 1 for a particular application by adjusting the power and frequency of the LF carrier signal. For example, the base station can be adapted so that the range of zone 1 approximates the dimensions of a desk drawer in which a plurality of tracked automobile keys are stored. Since any E-tags within range of the base station will receive the signal, any key in the drawer will receive the LF carrier signal and any key not in the drawer will not receive the LF carrier signal. In one preferred embodiment of the present invention a LF carrier signal of about 125 kHz is advantageously utilized. In another preferred embodiment, the range for E-tags to receive a LF carrier signal is up to about 3 ft.

Each E-tag receiving the LF carrier signal decodes the signal to determine whether the tag ID transmitted from the base station (via the LF carrier signal) matches the E-tag's ID. Methods and circuitry for decoding a modulated signal containing an ID are known in the art. However, applications utilizing RFID technology known in the art generally have the interrogator or reader decoding an ID-containing signal transmitted by the RFID tag. The present invention, to the contrary, requires the E-tag to do the decoding.

If the tag ID transmitted by the LF carrier signal matches the E-tag's ID, then that E-tag ("target E-tag") responds. Target E-tags can respond in a number of ways. Examples of target E-tag responses include activating a visual indicator such as a light (LED, for example) attached to the E-tag, activating an audio indicator such as a beeper or buzzer attached to the E-tag, and activating a vibrating mechanism attached to the E-tag. The E-tag responds to the base station with a status and ID information using a higher frequency RF signal ("response signal"). Typically, the status will be an indication that the E-tag is within range of the LF carrier signal (that is, is in zone 1 ). The response from the E-tag to the base station uses an RF signal for robust communication. Additionally, LF amplitude and polarity sweeps can be used to determine the approximate location of the E-tag/object and ascertain if it is inside zone 1.

If an E-tag is not within range of the LF carrier signal (that is, it is farther away or outside of zone 1), then the E-tag periodically transmits a response signal modulated to include the tag ID and an indication that the E-tag has not received a LF carrier signal (that is, it is outside of zone 1). This response signal only occurs if the E-tag does not detect a LF carrier signal. The E-tag interprets the absence of a LF carrier signal as an indication that the E-tag is no longer within zone 1 and begins periodically transmitting response signals. Thus, if a target E-tag receives a LF carrier signal, then the E-tag transmits a response signal to the base station indicating that the E-tag is within zone 1. If an E-tag does not receive a LF carrier signal, then the E-tag periodically transmits a response signal to the base station indicating that the E-tag is outside of zone 1.

Whenever the base station receives a response signal transmitted by an E-tag, the base station decodes the response signal to determine whether the transmitting E-tag is in zone 1 (that is, responding to the reception of a LF carrier signal) or in zone 2 (that is, responding to not receiving a LF carrier signal). If the base station does not receive a transmitted response signal, then the base station knows that the E-tag is outside the range of the transmitted response signal (that is, outside of zone 2).

Zone 2 is defined by the range of an E-tag's response signal. That is, if an E-tag is too far away from the base station to enable the base station to receive the response signal, then the E-tag is outside of zone 2. If the base station receives a response signal from an E-tag, then that E-tag is either in zone 1 or zone 2. The range of the response signal will vary with the frequency and/or power of the signal. Thus, one of ordinary skill in the art can choose the range of zone 2 for a particular application by adjusting the power and frequency of the response signal. For example, the response signal can be adapted so that the range of zone 2 approximates the dimensions of a room. Thus, if a tracked object is inside the room the base station will receive the response signal.

Response signals transmitted by E-tags generally have a frequency greater than about 0.1 MHz, and preferably, greater than about 100 MHz. Response signals transmitted by E-tags generally have a frequency less than about 2500 MHz, and preferably, less than about 1000 MHz. In one preferred embodiment of the present invention, a response signal having a frequency of 433.92 MHz is advantageously utilized. In another preferred embodiment, the range for base stations to receive a response signal is up to about 30 ft. Response signals may be modulated to transmit the tag ID or other data (status, for example) associated with the target object.

During a typical operation of a system of the present invention, a user first identifies an object to be tracked (an automobile key or a file, for example). The identification of the object to be tracked may be as simple as having the user pick the object from a list of objects displayed on a computer screen. Alternately, the user may use the computer to search a database containing objects that can be tracked. Each object that can be tracked has associated with it the tag ID of the E-Tag that is attached to the object. Accordingly, once a user identifies or determines the object to be tracked, the corresponding tag ID of the object is also determined. The tag ID is used by systems of the present invention to track the object. Methods for tracking objects in accordance with the present invention vary depending on the distance or range between the base station and the E-tag.

FIG. 1 illustrates a flowchart of a method 100 of the present invention performed on a base station in a system according to the present invention. In step 102, a user interacts with a user interface to choose (or otherwise identify) the object to be tracked. In step 104, the base station transmits the chosen object's tag ID via a LF carrier signal. In step 106, the base station checks to see if a response signal has been received. If the target object is within range of the base station, the target E-tag will receive the LF carrier signal and respond to the base station. This response includes a response signal modulated to include the tag ID and an indication that the E-tag received a LF carrier signal (that is, it is in zone 1).

In one preferred embodiment of the present invention, the target E-tag's response additionally includes the activation of a light-emitting device such as an LED that can easily be spotted by the user. Since the range of a LF carrier signal is relatively small the target object should be within visual sight of the user and the user will be able to spot the light-emitting device. For example, if the target object is an automobile key and the key is in a desk drawer, the light will enable the user to easily spot the target key upon opening the desk drawer.

Response signals have a longer range then LF carrier signals. Thus, if the target object is within range of a LF carrier signal from the base station then the base station is also within range of the response signal transmitted by the target E-tag. If the base station checks for a response signal 106 and a response signal is received, then the response signal is decoded 108 to determine the tag ID of the transmitting E-tag and to determine whether the E-tag is in zone 1 or zone 2. If the base station receives a response signal in response to a LF carrier signal, the object is located in the sense that the base station can indicate to the user through the user interface that the object is within zone 1 (typically a few feet) of the base station (that is, within range of a LF carrier signal). If the object has activated a light-emitting device (for example, an LED), the user will be able to easily spot the object. If the base station receives a response signal from an E-tag that has not received a LF carrier signal, then the object is located in the sense that the base station can indicate to the user through the user interface that the object is within zone 2 (typically a distance about the size of the room the base station is in). If the object has activated a sound-emitting device and/or a light-emitting device, then the user should be able to easily locate the object.

If the base station checks for a response signal 106 and a response signal is not received, then the base station can indicate to the user that the target object is outside of zone 2 110. If the user desires, the base station can then begin utilizing other methods to locate the object.

In another embodiment of the present invention, the base station is also capable of transmitting the tag ID via a modulated carrier signal that is transmitted at a higher frequency ("HF carrier signal") than the LF carrier signal. Generally, the frequency of the HF carrier signal will be greater than about 0.1 MHz, and preferably, greater than about 100 MHz. Generally, the frequency of the HF carrier signal will be less than about 2500 MHz, and preferably, less than about 1000 MHz. The range of the HF carrier signal containing the tag ID will vary with the frequency and power of the signal. Generally, a longer range is obtained from higher frequency signals. In one preferred embodiment of the present invention the HF carrier signal has the same frequency as the response signal that is transmitted by the E-tags. Any E-tags within range of the base station will receive the HF carrier signal. In one preferred embodiment, the range for E-tags to receive a HF carrier signal is up to about 30 ft.

Each E-tag receiving the HF carrier signal decodes the signal to determine whether the tag ID transmitted from the base station matches the E-tag's ID. If the tag ID transmitted by the HF carrier signal matches the E-tag's ID, then the target E-tag responds. E-tags receiving a HF carrier signal can respond in the same manner as E-Tags that receive a LF carrier signal. However, E-tags receiving a HF carrier signal are not required to respond in the exact same manner as E-Tags receiving a LF carrier signal. For example, an E-tag receiving only a HF carrier signal may respond by transmitting a response signal and activating a sound-emitting device on the object while an E-tag receiving a LF carrier signal may respond by transmitting a response signal and activating a light-emitting device on the object.

Figure 2:
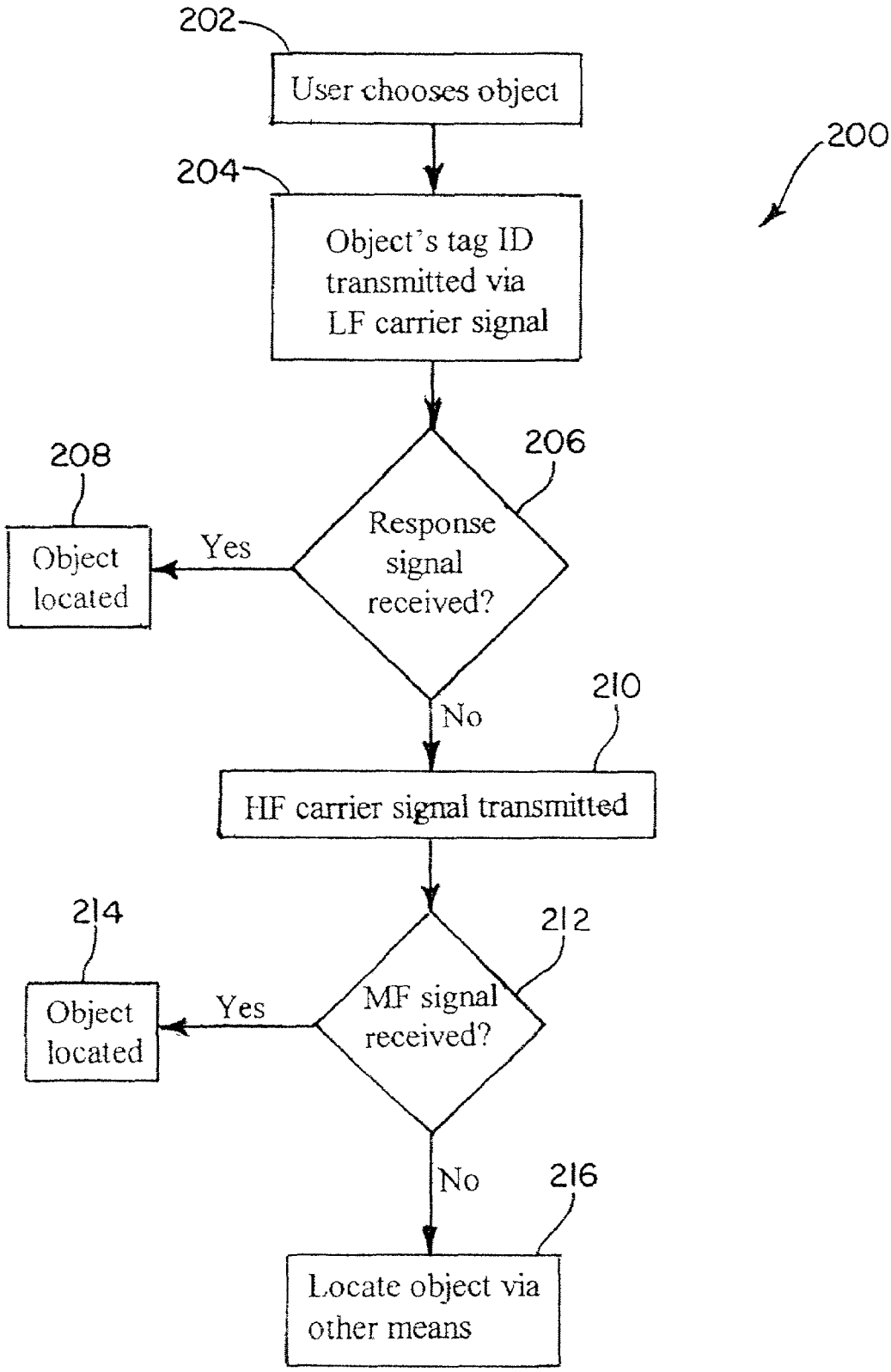
FIG. 2 illustrates a flowchart of a second method of the present invention.

FIG. 2 illustrates a flowchart of a method 200 of the present invention performed on a base station in a system according to the present invention. In step 202, a user interacts with a user interface to choose (or otherwise identify) the object to be tracked. In step 204, the chosen object's tag ID is transmitted via a LF carrier signal. If the target object is within range of the base station, the target E-tag will receive the LF carrier signal and respond to the base station. This response includes a response signal. In one preferred embodiment of the present invention, the target E-tag's response additionally includes the activation of a light-emitting device such as an LED.

Response signals have a longer range then LF carrier signals. Thus, if the target object is within range of a LF carrier signal from the base station then the base station is also within range of the response signal transmitted by the target E-tag. If a base station receives a response signal in response to a LF carrier signal 206, then object is located 208 in the sense that the base station can indicate to the user through the user interface that the object is within a short distance (typically a few feet) of the base station (that is, within range of a LF carrier signal) and the object will have activated a device (such as an LED) that allows the user to easily find the object.

If the base station does not receive a response signal in response to a LF carrier signal, then the target object is outside the range of LF carrier signal and the base station transmits a HF carrier signal 210. If the target object is within range of the base station, the target E-tag will receive the HF carrier signal and respond to the base station. This response includes a response signal. In one preferred embodiment of the present invention, the target E-Tag's response additionally includes the activation of a sound-emitting device.

HF carrier signals have a range that is as long as or longer than the response signal's range. Thus, even if the target E-tag receives a HF carrier signal and responds to it with a response signal, the base station will not receive the response signal if the base station is not within range of the response signal. Similarly, if the target object is within range of a response signal then the base station will receive the response signal transmitted by the target E-tag. If the base station receives a response signal in response to a HF carrier signal 212, the object is located 214 in the sense that the base station can indicate to the user through the user interface that the object is within range of a response signal. Typically, the response signal will be design to have a range of the size of a building or a room in the building. If the target E-tag has activated a sound-emitting device (for example) attached to the target object, then the user can easily find the object via the sound. If the base station does not receive a response signal in response to a HF carrier signal, then the object is outside the range of a response signal and the object via other methods 216.

Figure 3:
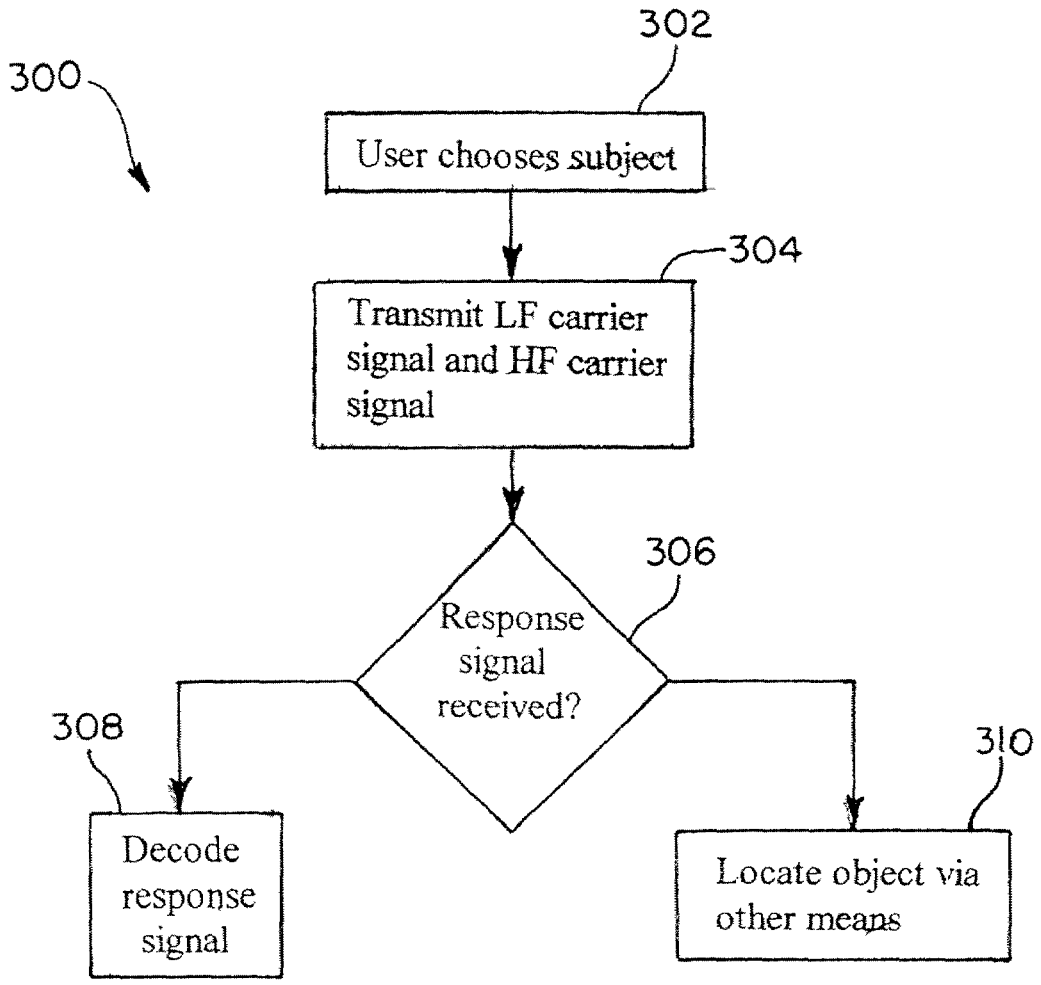
FIG. 3 illustrates a flowchart of a third method of the present invention.

FIG. 3 illustrates a method 300 according to another embodiment of the present invention. The user first chooses or otherwise identifies an object to be tracked 302. The base station then simultaneously transmits 304 both a LF carrier signal and a HF carrier signal. If the E-tag is in zone 1, it will receive both signals and transmit a response signal indicating that both signals were received. If the E-tag is in zone 2 it will receive only the HF carrier signal and will transmit a response signal indicating that only the HF carrier signal was received. If the E-tag is outside of zone 2, it will not receive either signal and cannot respond. In step 306, the base station checks to see if a response signal has been received. If a response signal is received, then the base station decodes 308 the response signal to determine if the E-tag is in zone 1 or zone 2. If no response signal is received, the E-tag can be located by other means, such as triangulation or utilizing global location circuitry.

Base stations and E-tags according to the present invention can also comprise RF circuitry adapted to allow an E-tag to be located via triangulation. Triangulation can be performed utilizing passive ranging, semi-passive ranging, or fully active ranging. For example, if an E-tag is within zone 1 zone 2 then short range passive or semi-passive ranging can be performed to triangulate the position of the E-tag and determine the exact location of the object to the operator. If the E-tag is outside of zone 2 then fully active ranging can be performed to triangulate the position of the E-tag.

Base stations and E-tags according to the present invention can also comprise global location circuitry, such as a global positioning satellite ("GPS") system and a worldwide wireless communication interface, such as a cellular phone to perform object position determination and communication to the base station. The position of the object can then be reported to the user.

Figure 4:
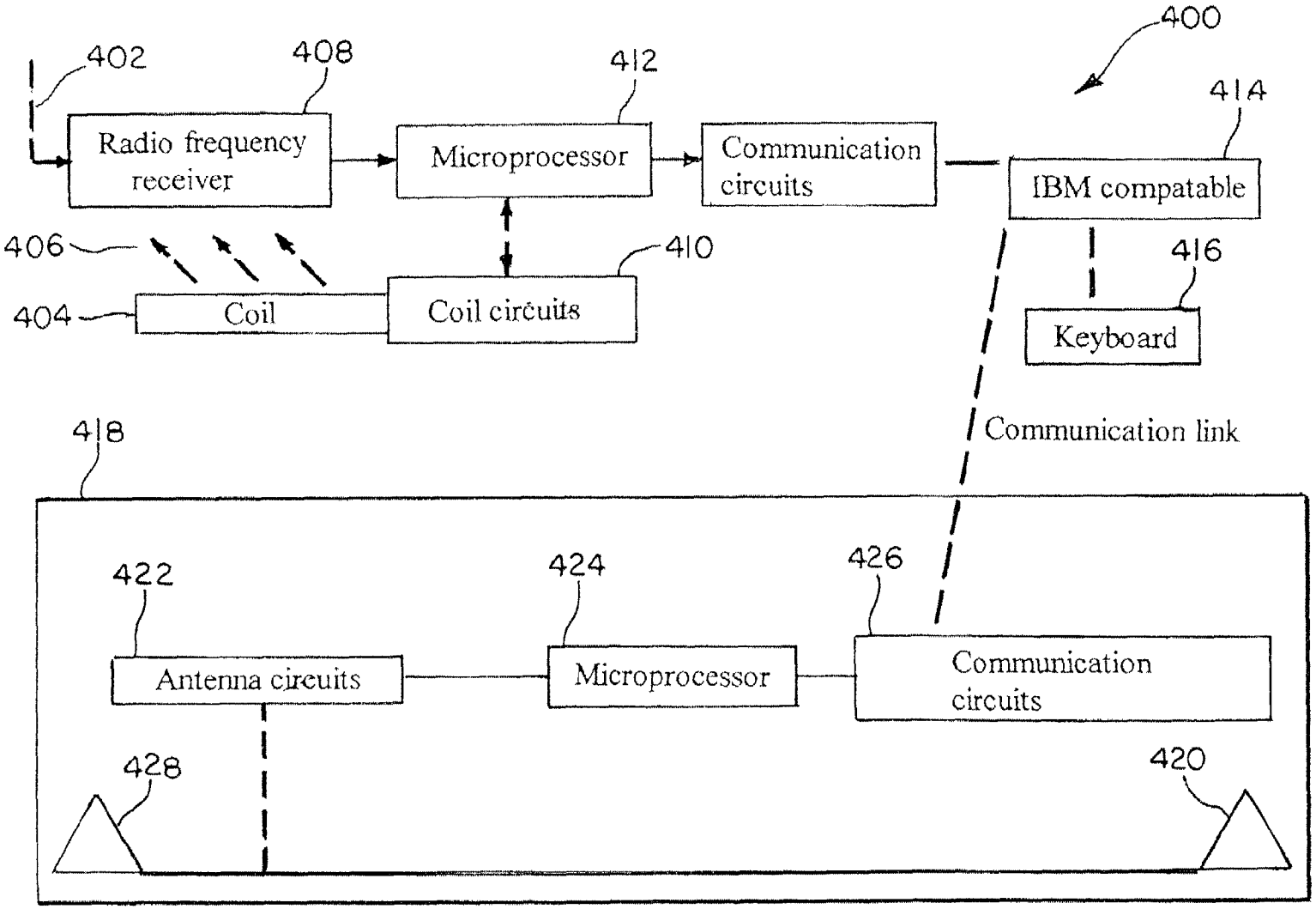
FIG. 4 illustrates a schematic of a base station of the present invention.

FIG. 4 illustrates a schematic of a base station 400 according to one embodiment of the present invention. Base stations of the present invention include a transceiver system having one or more antennas capable of transmitting and receiving signals at multiple frequencies. Base station 400 includes a PCB antenna 402 for radio frequency communications and a coil 404 to generate low frequency electrical inductive fields 406 for LF signals. In preferred embodiments of the present invention, antenna 402 and coil 404 are placed on a container or storage box such as a desk drawer, file cabinet, or safe. Base station 400 includes a radio frequency receiver 408 for use with the PCB antenna 402 and coil driver circuits 410 for use with coil 404. Transceiver systems of the present invention typically include a microprocessor 412 for controlling the antennas and interpreting the signals. The microprocessor 412 is in communication with a computer 414 or network. The computer 414 includes a keyboard 416. Generally, the computer 414 executes computer programs that implement a user interface as well as other programs such as database applications.

The base station 400 of FIG. 4 also illustrates a wave ID receiver system 418 for using triangulation to locate objects in accordance with the present invention. The wave ID receiver system 418 includes two antennas 420, antenna driver circuits 422, a microprocessor 424, and communication circuits 426. Wave ID receiver systems useful for triangulation in accordance with the present invention are known in the art. Thus, one or ordinary skill in the art of triangulation technology could readily implement a system such as the wave ID receiver system 418 shown in FIG. 4.

Figure 5:
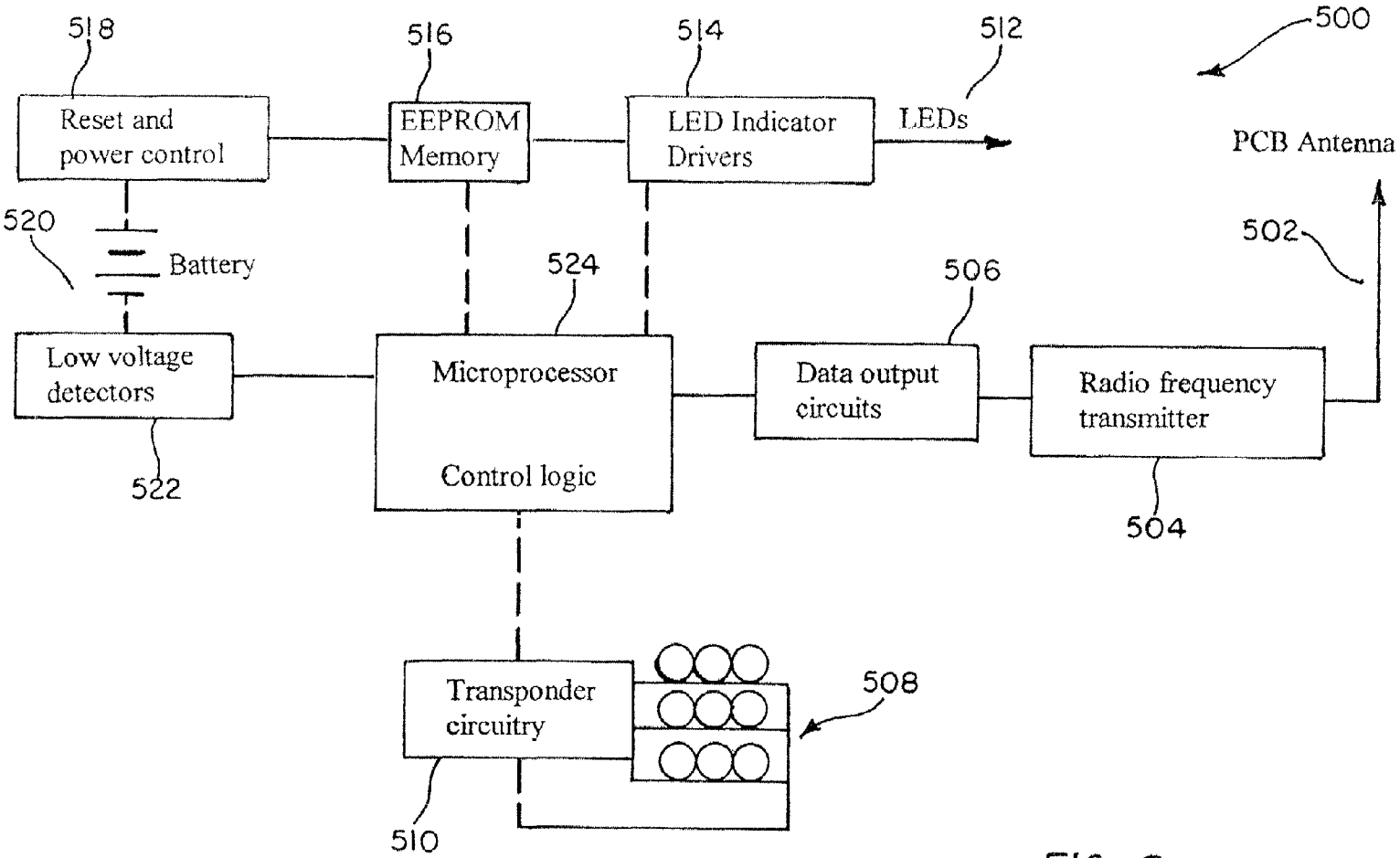
FIG. 5 illustrates a schematic of an electronic tag of the present invention.

FIG. 5 illustrates a schematic of an E-tag 500 according to one embodiment of the present invention. The E-tag 500 of FIG. 5 includes a PCB antenna 502, a radio frequency transmitter 504, and data output circuits 506 for high frequency communications. The E-tag 500 also includes three input coils 508 and transponder circuitry 510 for low frequency communications. The E-tag 500 further includes LED indicators 512, LED indicator drivers 514, EEPROM memory 516, a reset and power control 518, a battery 520, and a low voltage detector 522. The E-tag 500 also includes a microprocessor and control logic 524 for integrating and controlling the various parts of the E-tag 500.

In a preferred embodiment, the present invention is advantageously utilized to track automobile keys. This application of the present invention is particularly beneficially to organizations such as car dealerships where large numbers of keys need to be tracked. A user may wish to search for a single key to a particular automobile or multiple keys to different automobiles. For example, if a customer wishes to test drive two or more different models, the salesperson will need to locate the keys for those automobiles. A large number of keys can be placed in a container such as a desk drawer in any orientation. In a preferred embodiment, each key has a light-emitting device such as an LED attached to it.

In this embodiment, the desk drawer approximates zone 1. This can be done by mounting one or more coils used for the LF communications and choosing the power and frequency so that the range of the LF carrier signal approximates the dimensions of the drawer. In a preferred embodiment, three coils are placed on the drawer so they are orthogonal to each other. In this manner, each E-tag only needs a single coil for LF communications with the base station. The user interacts with the user interface to identify the key or keys to be located. Once the key or keys are identified the base station communicates with the target E-tag(s) using one or more of the techniques described above. If the target E-tag is in zone 1 (that is, the drawer) the E-tag activates the attached LED and the user interface indicates to the user that the key is in the drawer. The user can then open the drawer and look for the lighted LED.

If a target key is in zone 2, the user interface indicates to the user that the key is in zone 2. This could happen, for example, if a salesperson has forgotten to return the key. In a preferred embodiment, the range of an E-tag's response signal is design to approximate the dimensions of the room or building in which the base station is located. If the E-tag is equipped with a sound-emitting device that is activated, the user will know to look in the room or building for the source of the sound. Additionally, if a salesperson other than the user is carrying a key and the sound-emitting device is activated, the salesperson will be put on notice that somebody is looking for that key. Once the source of the sound is located, the key will have been located.

A target key may be outside of zone 2. This could happen, for example, if an automobile has left a dealership lot. If this is the case, then the user can initiate a search using triangulation or global location techniques.

While the present invention has been described in detail with respect to specific embodiments thereof, it will be appreciated that those skilled in the art, upon attaining an understanding of the foregoing, may readily conceive of alterations to, variations of and equivalents to these embodiments. Accordingly, the scope of the present invention should be assessed as that of the appended claims and ay equivalents thereto.

What is claimed is:

1. A method of locating objects, comprising the steps of:

attaching an E-tag to each object, each E-tag having a unique ID associated with the object to which the E-tag is attached, each E-tag adapted to receive a LF carrier signal, each E-tag adapted to receive a HF carrier signal, each E-tag adapted to determine whether a received LF carrier signal contains the E-tag's unique ID, each E-tag adapted to determine whether a received HF carrier signal contains the E-tag's unique ID, each E-tag adapted to transmit a response signal indicating a LF carrier signal was received, and each E-tag adapted to transmit a response signal indicating a HF carrier signal was received;

transmitting a LF carrier signal containing the unique ID associated with an object to be located;

transmitting a first response signal from any E-tag that receives a LF carrier signal containing the E-tag's unique ID, the first response signal indicating that a LF carrier signal was received;

checking whether a first response signal is received;

transmitting a HF carrier signal containing the unique ID contained in the transmitted LF carrier signal if no first response signal is received;

transmitting a second response signal from any E-tag that receives a HF carrier signal containing the E-tag's unique ID, the second response signal indicating that a HF carrier signal was received; and checking whether a second response signal is received.

2. The method of claim 1, further comprising the step of activating a light-emitting device on any E-tag that receives a LE carrier signal containing the B-tag's unique ID.

3. The method of claim 1, further comprising the step of activating a sound-emitting device on any E-tag that receives a HF carrier signal containing the E-tag's unique ID.

4. A system for locating objects, comprising:

a base station adapted to transmit a LF carrier signal containing a unique ID, the base station also adapted to receive a response signal having a higher frequency and longer range than the LF carrier signal;

a plurality of E-tags, each object having an E-tag attached to it, each E-tag having a unique ID associated with the object to which the E-tag is attached, each E-tag adapted to receive a LF carrier signal transmitted by the base station, each E-tag adapted to determine whether a received LF carrier signal contains the E-tag's unique ID, and each E-tag adapted to transmit a response signal indicating whether or not a LF carrier signal was received.

5. The system of claim 4, wherein the LF carrier signal is at a frequency greater than about 30 kHz and less than about 15 MHz.

6. The system of claim 4, wherein the response signal is at a frequency greater than about 0.1 MHz and less than about 2500 MHz.

7. The system of claim 4, wherein the response signal is at a frequency greater than about 100 MHz and less than about 1000 MHz.

8. The system of claim 4, wherein the plurality of E-tags are adapted to activate a light-emitting device.

9. The system of claim 4, wherein the plurality of E-tags are adapted to activate a sound-emitting device.

10. The system of claim 4, wherein the base station is adapted to transmit a LF carrier signal having a range of up to about 3 feet.

11. The system of claim 4, wherein each E-tag is adapted to transmit a response signal having a range of up to about 30 feet.

12. A system for locating objects, comprising:

a base station adapted to transmit a LF carrier signal containing a unique ID associated with an object to be located, the base station adapted to transmit a HF carrier signal containing a unique ID associated with an object to be located, and the base station adapted to receive a response signal having a higher frequency and longer range than the LF carrier signal;

a plurality of E-tags, each object having an E-tag attached to it, each E-tag having a unique ID, each E-tag adapted to receive a LF carrier signal transmitted by the base station, each E-tag adapted to receive a HF carrier signal transmitted by the base station, each E-tag adapted to determine whether a received LF carrier signal or a received HF carrier signal contains the E-tag's unique ID, and each E-tag adapted to transmit a response signal indicating whether or not a LF carrier signal was received.

13. The system of claim 12, wherein the LF carrier signal is at a frequency greater than about 30 kHz and less than about 15 MHz.

14. The system of claim 12, wherein the response signal is at a frequency greater than about 0.1 MHz and less than about 2500 MHz.

15. The system of claim 12, wherein the response signal is at a frequency greater than about 100 MHz and less than about 1000 MHz.

16. The system of claim 12, wherein the HF carrier signal and the response signal are at the same frequency.

17. The system of claim 12, wherein the plurality of E-tags are adapted to activate a light-emitting device.

18. The system of claim 12, wherein the plurality of E-tags are adapted to activate a sound-emitting device.

19. The system of claim 12, wherein the base station is adapted to transmit a LF carrier signal having a range of up to about 3 feet.

20. The system of claim 12, wherein each E-tag is adapted to transmit a response signal having a range of up to about 30 feet.

21. The system of claim 12, wherein the system further comprises a plurality of antennas adapted to communicate with the base station and the E-tags for triangulating the position of the E-tags.

22. A method of locating objects, comprising the steps of:

attaching an E-tag to each object, each E-tag having a unique ID associated with the object to which the E-tag is attached, each E-tag adapted to receive a LF carrier signal, each E-tag adapted to determine whether a received LF carrier signal contains the E-tag's unique ID, and each E-tag adapted to transmit a response signal indicating whether or not a LF carrier signal was received;

transmitting a LF carrier signal containing a unique ID associated with an object to be located;

transmitting a first response signal from any E-tag that receives a LF carrier signal containing the E-tag's unique ID, the first response signal indicating that a LF carrier signal was received; and periodically transmitting a second response signal from any E-tag that has not received a LF carrier signal, the second response signal indicating that no LF carrier signal has been received.

23. The method of claim 22, further comprising the step of activating a light-emitting device on any E-tag that receives a LF carrier signal containing the E-tag's unique ID.

24. A method of locating objects, comprising the steps of:

attaching an E-tag to each object, each E-tag having a unique ID associated with the object to which the E-tag is attached, each E-tag adapted to receive a LF carrier signal, each E-tag adapted to receive a HF carrier signal, each E-tag adapted to determine whether a received LF carrier signal contains the E-tag's unique ID, each E-tag adapted to determine whether a received HF carrier signal contains the E-tag's unique ID, each E-tag adapted to transmit a response signal indicating a LF carrier signal was received, and each E-tag adapted to transmit a response signal indicating a HF carrier signal was received;

transmitting a LF carrier signal containing the unique ID associated with an object to be located;

transmitting a HF carrier signal containing the unique ID contained in the transmitted LF carrier signal;

transmitting a first response signal from any E-tag that receives a LF carrier signal containing the E-tag's unique ID, the first response signal indicating that a LF carrier signal was received;

transmitting a second response signal from any E-tag that receives a HF carrier signal containing the E-tag's unique ID, the second response signal indicating that a HF carrier signal was received;

checking whether a first response signal is received; and checking whether a second response signal is received.

25. The method of claim 24, further comprising the step of activating a light-emitting device on any E-tag that receives a LF carrier signal containing the E-tag's unique ID.

26. The method of claim 24, further comprising the step of activating a sound-emitting device on any E-tag that receives a HF carrier signal containing the E-tag's unique ID.

* * * * *